US005161882A

United States Patent [19]

Garrett

[11] Patent Number: 5,161,882

[45] Date of Patent: Nov. 10, 1992

[54] CHRISTMAS LIGHTING ORGANIZER APPARATUS

[76] Inventor: Joe L. Garrett, P.O. Box 951, Baytown, Tex. 77522

[21] Appl. No.: 745,168

[22] Filed: Aug. 15, 1991

[51] Int. Cl.[5] ..... F21P 1/02

[52] U.S. Cl. ..... 362/249; 362/219; 362/221; 362/252; 362/806

[58] Field of Search ..... 362/123, 145, 152, 219, 362/226, 227, 249, 362, 392, 806, 810, 221, 252

[56] References Cited

U.S. PATENT DOCUMENTS

| | | | |
|---|---|---|---|
| 3,204,090 | 8/1965 | Kvarda, Jr. | 362/249 |
| 3,450,872 | 6/1969 | Aiello, Jr. | 362/249 |
| 3,775,607 | 11/1973 | Blomstedt | 362/249 |
| 3,836,760 | 9/1974 | Robinson | 362/249 |
| 4,425,605 | 1/1984 | Cheng | 362/221 |
| 4,639,841 | 1/1987 | Salestrom et al. | 362/227 |
| 4,959,761 | 9/1990 | Critelli et al. | 362/226 |
| 5,067,061 | 11/1991 | Prickett | 362/806 |

FOREIGN PATENT DOCUMENTS 553209 2/1958 Canada ..... 362/227

*Primary Examiner*—Ira S. Lazarus
*Assistant Examiner*—Y. Quach
*Attorney, Agent, or Firm*—Leon Gilden

[57] ABSTRACT

A unitary housing includes a plurality of spaced sockets therewithin, wherein the sockets are in electrical communication with one another and a first end wall, including a socket receptacle and a second end wall including a socket plug. The sockets in this manner are arranged for an in-line series securement relative to one another for mounting to an exterior surface of a dwelling for example. The housing further includes mounting flanges arranged for mounting of the housing to an underlying surface. A modification of the invention includes translucent lens structure secured to the housing to provide various enhancement to the illumination bulbs mounted within the housing.

3 Claims, 4 Drawing Sheets

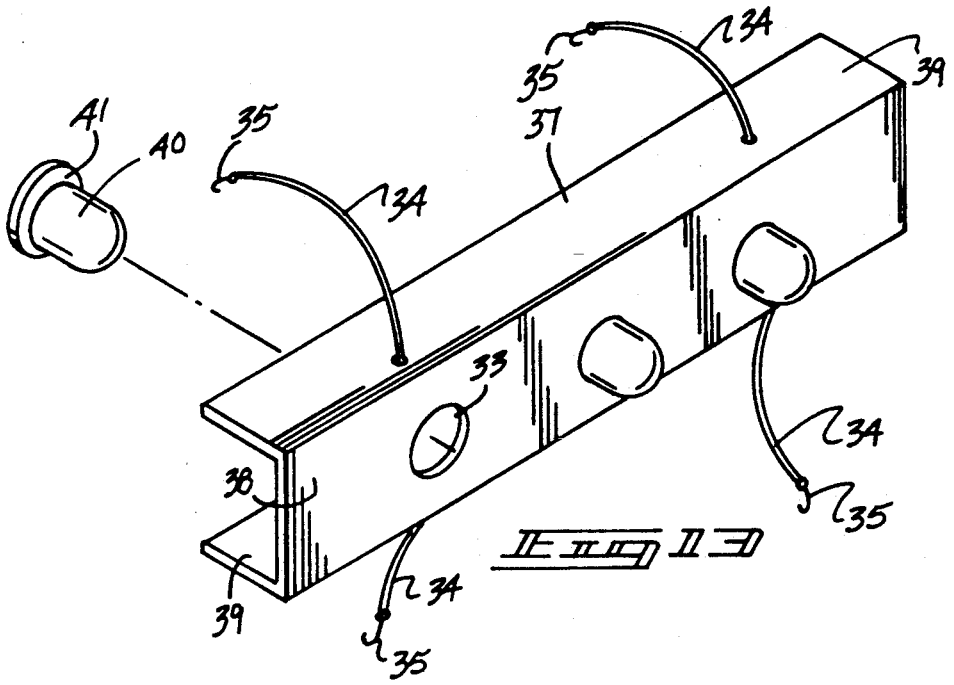
Fig 13
Fig 15
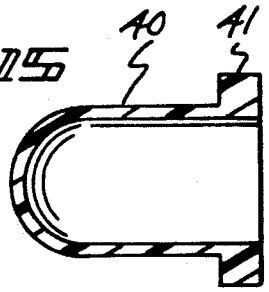
Fig 14
Fig 16
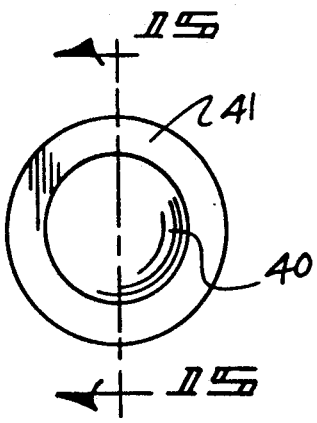
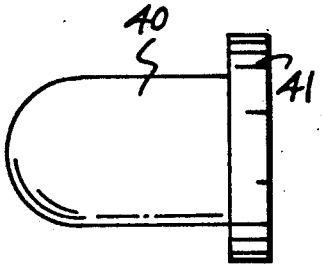

CHRISTMAS LIGHTING ORGANIZER APPARATUS

BACKGROUND OF THE INVENTION

1. Field of the Invention

The field of invention relates to Christmas lighting apparatus, and more particularly pertains to a new and improved Christmas lighting organization apparatus wherein the same is arranged for convenient tangle-free mounting of decorative lights relative to a dwelling.

2. Description of the Prior Art

Various modules and the like have been utilized for mounting lighting structure to a dwelling. Such modules are exemplified in U.S. Pat. No. 4,774,646 to L'Heureux wherein a strip member mounts various bulbs thereto.

U.S. Pat. No. 4,890,206 to Lee sets forth a Christmas light compiler structure supporting light sets, including sockets mounted within plate structure receiving such lights.

U.S. Pat. No. 4,885,664 to Hermanson sets forth a Christmas tree light sheath generally tubular and formed of a cross-sectional configuration corresponding to an Archimedes spiral.

U.S. Pat. No. 4,591,227 to Colonna sets forth a Christmas tree light set for illumination of Christmas trees utilizing a dics structure mounted to an uppermost portion of a tree mounting the lights therewithin.

U.S. Pat. No. 4,870,547 to Crucefix wherein Christmas tree lights are mounted in a parallel relationship at junctures relative to a mounting structure.

As such, it may be appreciated that there continues to be a need for a new and improved Christmas lighting organizer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of Christmas lighting apparatus now present in the prior art, the present invention provides a Christmas lighting organizer apparatus wherein the same is arranged to provide flexible housing arranged for an end-to-end securement relative to one another for mounting to a support surface such as a dwelling. As such, the general purpose of the present invention, which will be described subsequently in greater detail, is to provide a new and improved Christmas lighting organizer apparatus which has all the advantages of the prior art Christmas lighting apparatus and none of the disadvantages.

To attain this, the present invention provides a unitary housing including a plurality of spaced sockets therewithin, wherein the sockets are in electrical communication with one another and first end wall, including a socket receptacle and second end wall including a socket plug. The sockets in this manner are arranged for an in-line series securement relative to one another for mounting to an exterior surface of a dwelling for example. The housing further includes mounting flanges arranged for mounting at the housing to an underlying surface. A modification of the invention includes translucent lens structure secured to the housing to provide various ehancement to the illumination bulbs mounted within the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas lighting organizer apparatus which has all the advantages of the prior art Christmas lighting apparatus and none of the disadvantages.

It is another object of the present invention to provide a new and improved Christmas lighting organizer apparatus which may be easily and efficiently manufactured and marketed.

It is a further object of the present invention to provide a new and improved Christmas lighting organizer apparatus which is of a durable and reliable construction.

An even further object of the present invention is to provide a new and improved Christmas lighting organizer apparatus which is susceptible of a low cost of manufacture with regard to both materials and labor, and which accordingly is then susceptible of low prices of sale to the consuming public, thereby making such Christmas lighting organizer apparatus economically available to the buying public.

Still yet another object of the present invention is to provide a new and improved Christmas lighting organizer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic end view of the plate structure, as set forth in FIG. 9.

FIG. 13 is a modified lens structure utilized by the housing of FIG. 1.

FIG. 14 is an orthographic view of a bulb lens dome utilized by the invention.

FIG. 15 is an orthographic view, taken along the lines 15—15 of FIG. 14 in the direction indicated by the arrows.

FIG. 16 is an orthographic side view of the dome structure, as set forth in FIG. 14.

DESCRIPTION OF THE PREFERRED EMBODIMENT

Figure 1:
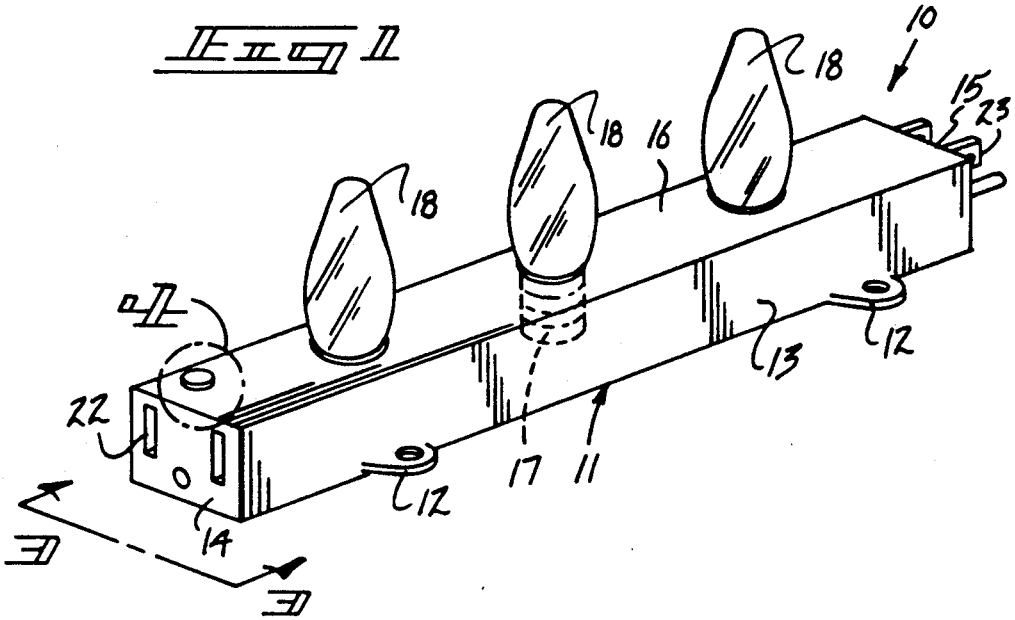
FIG. 1 is an isometric illustration of the instant invention.
Figure 4:
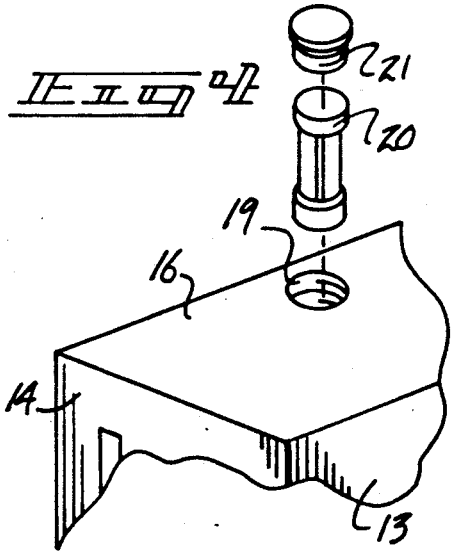
FIG. 4 is an isometric partial segmented view of the fuse member mounted within the housing structure.
Figure 3:
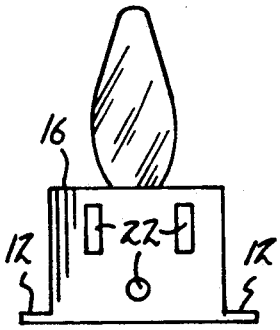
FIG. 3 is an orthographic end view, taken along the lines 3—3 of FIG. 1 in the direction indicated by the arrows.
Figure 2:
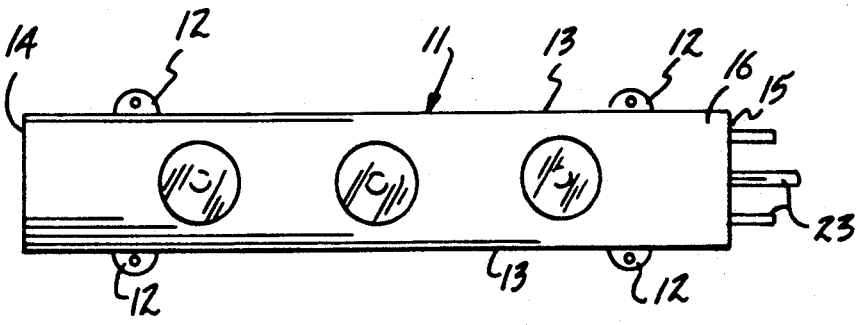
FIG. 2 is an orthographic top view of the instant invention.

With reference now to the drawings, and in particular to FIGS. 1 to 16 thereof, a new and improved Christmas lighting organizer apparatus embodying the principles and concepts of the present invention and generally designated by the reference numeral 10 will be described.

More specifically, the Christmas lighting organizer apparatus 10 of the instant invention essentially comprises a flexible unitary support housing 11, including spaced housing side walls 13, a first end wall 14 spaced from and parallel to a second end wall 15. A top wall 16 orthogonally oriented relative to the first and second end walls 14 and 15 permit an end-to-end securement of a plurality of housings 11 together, wherein the first end wall 14 includes an electrical plug receptacle 22 directed interiorly thereof and the second end wall 15 including an electrical plug assembly 23 projecting exteriorly thereof orthogonally oriented relative to the second end wall 15 for securement to an adjacent housing 11 of identical construction, as illustrated in FIG. 1. A plurality of electrical receptacle sockets 17 are directed through the top wall 16, each including illumination bulb 18 therewithin, with the bulbs in electrical communication between one another and the receptacle 22 and plug 23. A fuse holder bore 19 is provided through the top wall receiving a fuse 20 removably therefrom, with a cap member 21 directed above the fuse to permit selective replacement of the fuse as required. The illumination bulbs in association with the plug receptacle 22 and electrical plug 23 are in series electrical communication relative to one another in a conventional manner. Accordingly, it should be noted that apertured mounting flanges 12 are mounted adjacent an intersection of a floor and each side wall 13, with the mounting flanges 12 orthogonally oriented relative to each side wall, each including an aperture therethrough to permit mounting of each housing relative to an underlying surface, such as on a dwelling, for ornamentally mounting the housing and a series of such housing 11 in a manner for decorative illumination purposes, such as in a Christmas lighting event.

Figure 5:
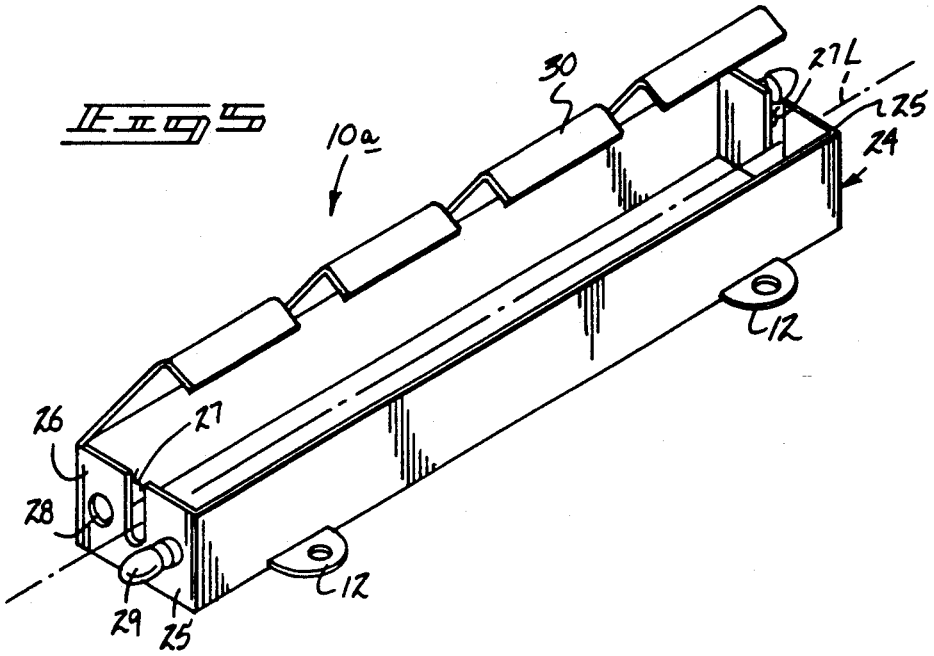
FIG. 5 is an isometric illustration of a modified housing structure utilized by the invention.
Figure 6:
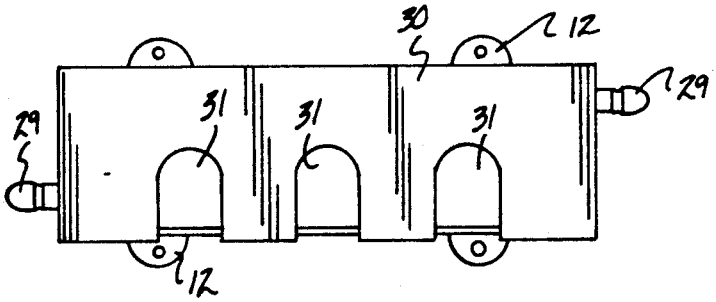
FIG. 6 is an orthographic to view of the invention, as set forth in FIG. 5.
Figure 7:
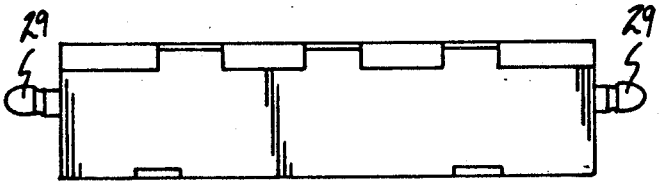
FIG. 7 is an orthographic side view of the invention, as set forth in FIG. 5.
Figure 8:
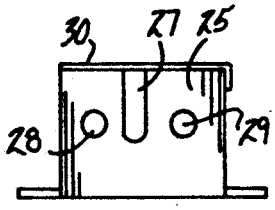
FIG. 8 is an orthographic end view of the invention, as set forth in FIG. 5.
Figure 9:
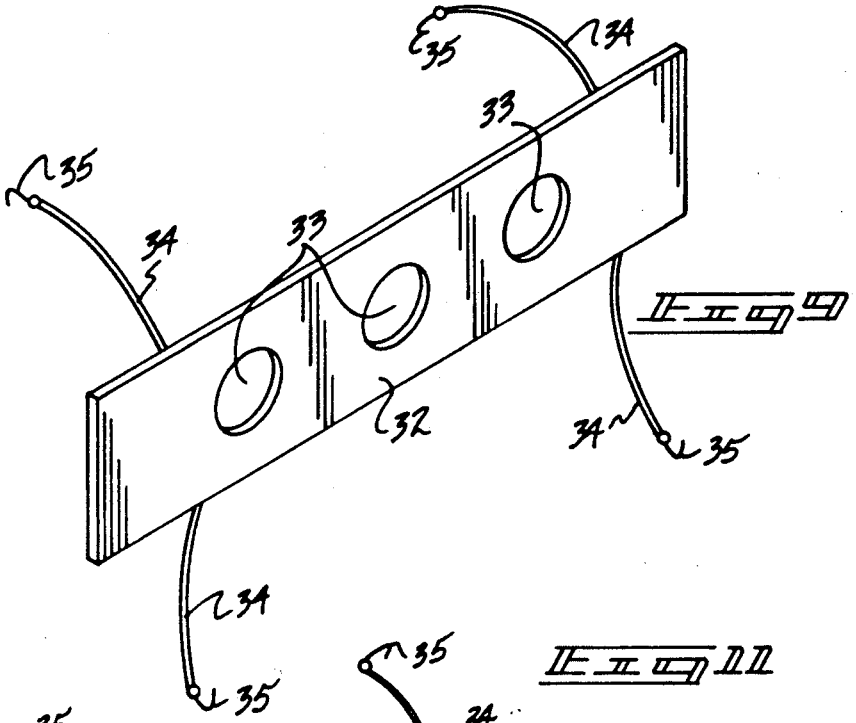
FIG. 9 is an isometric illustration of a translucent plate utilized in conjunction with the housing structure of FIG. 1.
Figure 11:
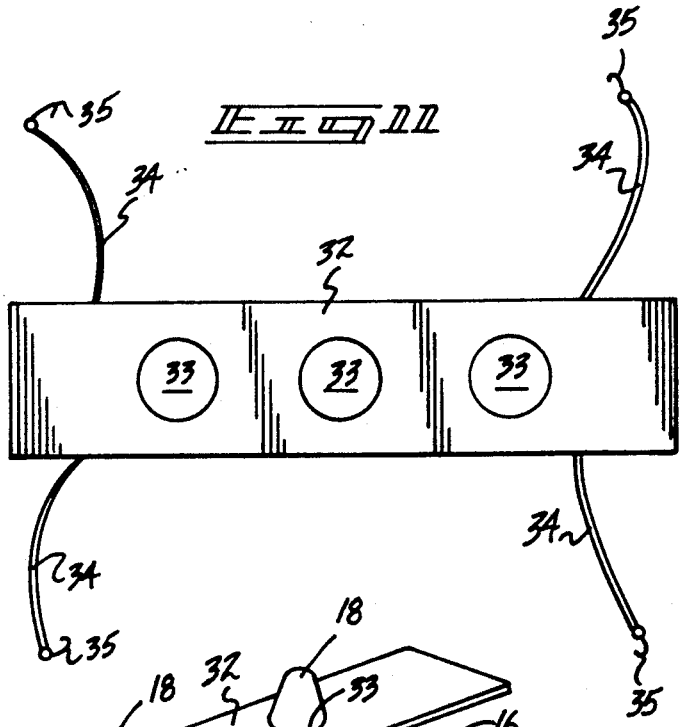
FIG. 11 is an orthographic top view of the plate, as set forth in FIG. 9.
Figure 11A:
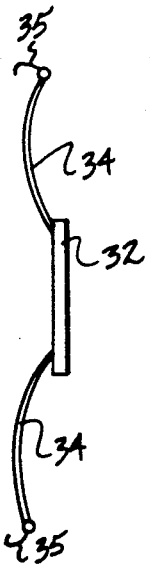

FIG. 5 illustrates the use of a modified apparatus **10*a*, wherein a securement housing 24 includes end walls 25, with an upper edge 26, including a slot 27 directed dowmwardly relative to each end wall 25. The slot and interior cavity of the housing 24 permits accommodate of a lighting string "L", as illustrated in FIG. 5, directed therethrough permitting electrical cords to be directed therethrough, wherein the organization includes a cover flap lid 30 including lid slots 31 arranged in a parallel spaced relationship to permit projection of individual bulbs therethrough. An engagement boss 29 is mounted to a right side of each slot 27, with a bore 28 mounted to a left side thereof to permit securement of adjacent securement housings together in an end-to-end relationship. The apertured mounting flanges 12 are mounted to the side walls, in a manner discussed relative to the housing 11**.

Figure 12:
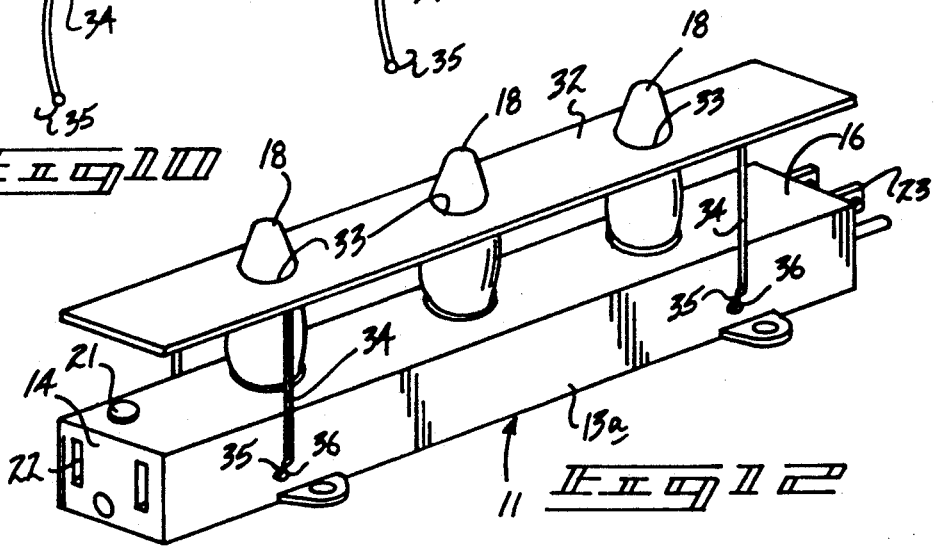
FIG. 12 is an isometric illustration of the housing and plate structure in use.

FIGS. 9–12 illustrate the use of a translucent color tinted lens 32, including lens openings 33 spaced apart a predetermined spacing equal to a predetermined spacing defined between illumination bulbs 18. The illumination bulbs are defined by a bulb diameter greater than the lens opening diameter 33 to effect positioning of the lens 32 in a spaced relationship relative to the top wall 16 in use, as illustrated in FIG. 12. The flexible lens 32 includes a plurality of elastomeric straps 34 mounted to each side edge of the lens 32 that is defined by a length between the first and second end walls 14 and 15 of the housing 11. A plurality of side wall bores 36 are directed through each side wall of the modified side walls **13*a* of the housing 11 to receive a strap hook 35 of each strap therewithin to thereby mount the lens 32 to the housing 11**.

FIGS. 13–16 illustrate the use of a "U" shaped translucent lens 37, wherein the lens includes a lens top wall 38 and spaced parallel side walls 39. The side walls 39 are spaced apart by a side wall spacing equal to a like side wall spacing between the side walls **13*a* of the housing 11, as illustrated in FIG. 12. The "U" shaped lens side walls 39 and top wall of the "U" shaped translucent lens 37 are each formed of a translucent color tinted construction to modify illumination directed therethrough. Further, lens openings 33 receive replacement translucent bulb lens domes 40 to be utilized with a contrasting coloration to thereby modify the coloration of the bulbs 18 as desired. Each dome 40 is defined by a cylindical side wall of a predetermined diameter equal to the predetermined diameter of the lens openings 33. Each dome 40 includes a dome flange 41 defined by a flange diameter greater than the predetermined diameter to secure the domes relative to the lens top wall 38**, as illustrated, in a frictional inter-relationship.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Christmas lighting organizer apparatus, comprising, a flexible unitary support housing, the flexible unitary support housing including a top wall spaced from and parallel to a bottom wall, and spaced parallel side walls spaced apart a predetermined side wall spacing, and a first end wall spaced from and parallel to a second end wall, wherein the first and second end walls are orthogonally oriented relative to the top and bottom walls, and the top wall including a plurality of electrical receptacle sockets, the electrical receptacle sockets spaced apart a predetermined socket spacing, a plurality of ilumination bulbs, with each of the electrical receptacle sockets receiving a single illumination bulb of said plurality of illumination bulbs, and an electrical plug receptacle directed orthogonally and interiorly of the electrical receptacle housing through the first end wall, and an electrical plug extending orthogonally exteriorly of the second end wall, wherein the electrical plug receptacle, the electrical plug, and the electrical receptacle sockets are each in electrical communication relative to one another, and the flexible unitary support housing includes a fuse holder bore directed interiorly of the flexible unitary support housing, the fuse holder bore removably mounting a fuse member therewithin, and a cap member selectively mounted over the fuse member within the fuse holder bore permitting selective removal of the fuse member relative to the fuse holder bore, wherein the fuse member is in electrical communication between the electrical plug receptacle and the electrical plug.

2. A christmas lighting organizer apparatus as set forth in claim 1 including a translucent color tinted lens, the color tinted lens defined by a predetermined length extending from the first end wall to the second end wall, the translucent color tinted lens including a plurality of lens openings, with a single lens opening of the plurality of lens openings aligned with said each single illumination bulb of said plurality of illumination bulbs, wherein each lens opening receives said illumination bulb therethrough.

3. A christmas lighting organizer apparatus as set forth in claim 2 wherein the translucent color tinted lens includes spaced side edges, and the translucent color tinted lens defined by a predetermined width equal to a side wall spacing defined between the flexible unitary support housing spaced parallel side walls, and each edge including a plurality of elastomeric straps, each strap including a hook member, each hook member mounted to a distal terminal end of each elastomeric strap spaced from the translucent color tinted lens, and each housing side wall including a plurality of side wall bores, with each bore of the plurality of side wall bores receiving a hook member therewithin for securement of the translucent color tinted lens relative to the flexible unitary support housing.

* * * * *